United States Patent [19]

Engquist

[11] 4,168,610

[45] Sep. 25, 1979

[54] EXHAUST MANIFOLD WITH REFLECTIVE INSULATION

[75] Inventor: Karl R. Engquist, Peoria, Ill.

[73] Assignee: Caterpillar Tractor Co., Peoria, Ill.

[21] Appl. No.: 891,260

[22] Filed: Mar. 29, 1978

[51] Int. Cl.[2] ..... F01N 7/10

[52] U.S. Cl. ..... 60/322; 60/282; 60/323; 164/98; 164/108; 164/112

[58] Field of Search ..... 60/282, 272, 322, 323; 164/98, 108, 112

[56] References Cited

U.S. PATENT DOCUMENTS

| | | | |
|---|---|---|---|
| 2,886,945 | 5/1959 | Hofer | 60/321 |
| 3,173,451 | 3/1965 | Slayter | 138/145 |
| 3,324,533 | 6/1967 | Watteau | 29/156.4 WL |
| 3,413,803 | 12/1968 | Rosenlund | 60/274 |
| 3,581,494 | 6/1971 | Scheitlin | 60/282 |
| 3,709,722 | 1/1973 | Rice | 427/295 |
| 3,722,221 | 3/1973 | Chopin | 60/282 |
| 3,750,403 | 8/1973 | Deutschmann | 60/323 |
| 3,775,979 | 12/1973 | Scheitlin | 60/322 |
| 3,799,196 | 3/1974 | Scheitlin | 137/561 A |
| 3,864,908 | 2/1975 | Lahaye | 60/272 |
| 4,077,458 | 3/1978 | Hayashi | 60/282 |
| 4,106,288 | 8/1978 | Nagaishi | 60/282 |

*Primary Examiner*—Douglas Hart

*Attorney, Agent, or Firm*—Wegner, Stellman, McCord, Wiles & Wood

[57] ABSTRACT

A manifold for internal combustion engines is provided which has a unique insulation system for maintaining a skin temperature of the manifold below 400° F. The manifold includes an exhaust conduit made up of axially spaced and aligned segments with provision for preventing excessive leakage of exhaust gases between the spaced segments. Each segment has an exhaust port extending at an angle thereto. Two or more members of corrugated or crumpled thin foil are concentrically arranged about the ports and about the conduit with air gaps between the conduit and the innermost member, between the port and the innermost member, and between each member. An outer casing is cast about the members and embeds the ends of the members therein. The foil from which the members are made is polished on the surfaces to be highly reflective thereby reducing the transfer of heat through the successive concentric members. A method of manufacturing the improved insulated manifold is provided.

16 Claims, 12 Drawing Figures

EXHAUST MANIFOLD WITH REFLECTIVE INSULATION

BACKGROUND OF THE INVENTION

1. Field of the Invention

This invention relates to manifolds for internal combustion engines and, more particularly, to an insulated manifold and a method of manufacturing same.

2. Description of the Prior Art

Insulated manifolds have broadly been known for many years. The most common type of insulated manifold being the type that has an exhaust conduit in contact with the exhaust gases, which conduit is surrounded by a layer of insulating material which may or may not have a water jacket surrounding the layer of insulating material. These prior devices have experienced difficulty due to thermal expansion of parts of the manifold which cause failure due either to thermal fatigue or to the mechanical stresses caused by said expansion.

SUMMARY OF THE INVENTION

The present invention is directed to overcoming one or more of the problems as set forth above.

According to the present invention, an insulated manifold is provided making use of radiation shielding between the exhaust conduit and the outer casing of the manifold. The manifold includes a casing made up of axially aligned cast sections with each section bridging, for instance, two cylinder ports. Within each cast section of the manifold, two segments of an exhaust conduit are provided with a slip joint between the segments to eliminate thermal stresses. Two or more concentric members of corrugated or ribbed foil are provided which members are spaced apart by the corrugations or by ribs which contact the corrugations or ribs on the adjacent member to provide air gaps or air spaces between the two members. The surface of the foil is highly reflective so that a large amount of the heat from the exhaust is reflected back into the exhaust conduit. The successive layers of spaced apart reflective foil members results in relatively little heat being passed to the outer casing of the manifold so that the surface temperature of the casing is maintained below 400° F.

A method of manufacturing a manifold is provided wherein sections of the manifold are manufactured by providing adjacent segments of an exhaust conduit with a slip joint therebetween. Each segment may have a port branch angularly disposed thereto. Two or more corrugated members of reflective material are formed on a mandrel shaped like the port branch to form a corrugated port element. A port element is assembled over each port branch. Two or more corrugated members of reflective material are formed around the segments of the exhaust conduit. Each corrugated member is spaced from its adjacent member by a small air gap. A port sleeve may be fitted over the corrugated port elements. A wrap is provided around the outer surface of the outermost corrugated member and port elements and a core wash is used to seal the open ends of the corrugations whereupon the wrapped members are placed in a mold and an outer casing is cast thereabout with the ends of the foil members and ends of the corrugated port elements of the foil members embedded in the material of the casing. The casing has flanges at each end and at the ends of the port branches for connection to an end cap, for connection to adjacent sections of the manifold or for connection to an engine block.

BRIEF DESCRIPTION OF THE DRAWING

The details of construction and operation of the invention are more fully described with reference to the accompanying drawing which forms a part hereof and in which like reference numerals refer to like parts throughout.

In the drawing.

DESCRIPTION OF THE PREFERRED EMBODIMENT

Figure 1:
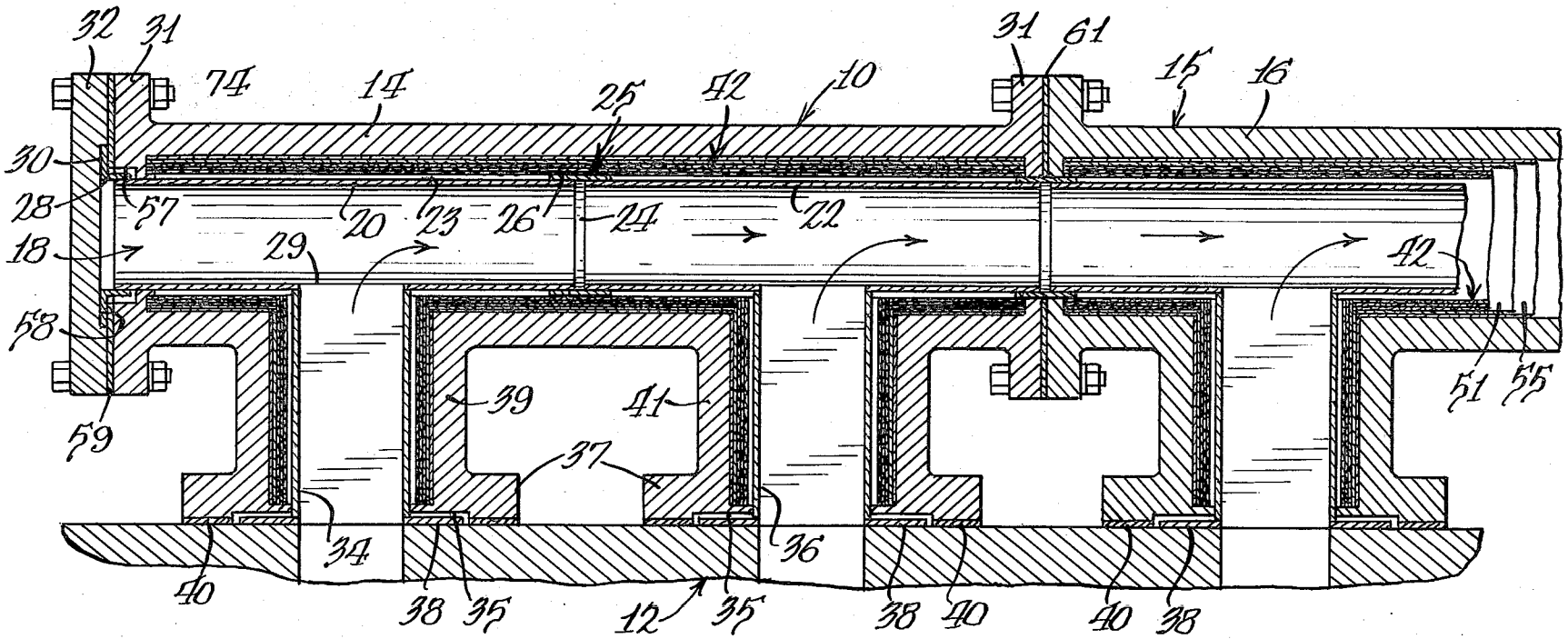
FIG. 1 is an elevational cross-sectional view through a portion of a manifold showing the elements of the invention.

Referring to the drawing, the numeral 10 designates a portion of a manifold which is shown attached to a broken away portion of an engine block 12. The manifold 10 is comprised of a casing 15 made up of two or more axially aligned, joined together sections 14,16, and the like. It is to be understood that, for instance, for a V8 engine, the casing 15 would have two sections 14 and 16 for each side of the engine. In case the engine is a six cylinder in-line or eight cylinder in-line engine, there would be three or four sections, respectively, so as to accommodate the number of cylinders in the engine. For the purposes of this disclosure, only one section 14 of the casing 15 will be discussed in detail, it being understood that two or more sections, like sections 14,16, would be bolted together to form the casing 15 of a manifold 10 according to the dictates of the invention.

Figure 3:
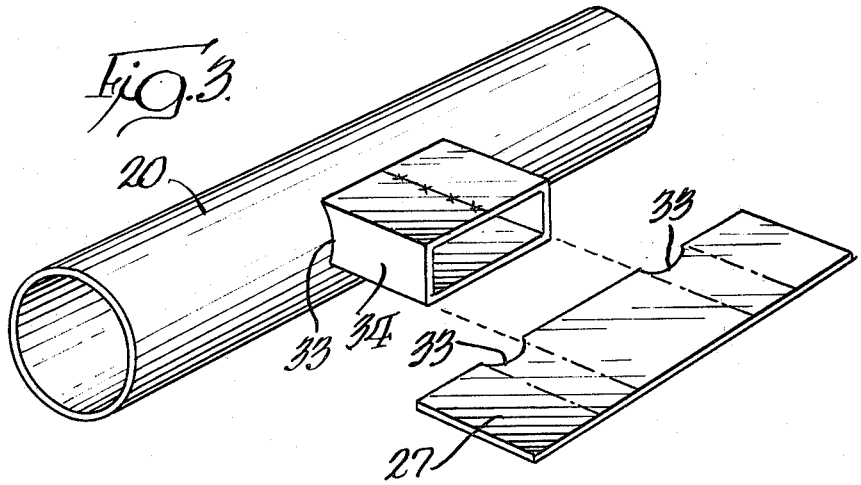
FIG. 3 is a perspective view of a piece of a segment of a conduit with a port branch shown both in a flat developed form and in attached relationship to said conduit.

Section 14 of the manifold is comprised of an exhaust conduit 18 which is divided into two segments 20 and 22 which segments are axially aligned with each other and have a small axial spacing 24 therebetween. A slip joint 25 encircles the adjacent end portions of the segments 20 and 22 and includes a sleeve 26 which bridges the spacing 24 between said segments. The slip joint 25 restricts or eliminates leakage of exhaust gases through the open space 24 between the ends of the adjacent segments 20 and 22. Referring to FIGS. 1 and 3, each segment 20 and 22 has a transversely extending branch port 34,36, respectively. The segments 20 and 22 may be made of thin stainless steel seamless tubing and, due to the spacing 24 and slip joint 25 between the ends thereof, are permitted to elongate without creating thermal stresses on the ends of the manifold.

For purposes of illustration, the segments 20, 22 are shown as circular in cross section with the port branches 34,36 being shown as rectangular. It is to be understood that the conduit, casing, port branches, and insulating body could be square, rectangular, oval, or the like, in cross section without departing from the invention. The port branches, such as branch 34, are formed from a developed sheet 27 having cutouts 33, such that when formed on a mandrel with the ends of the developed sheet 27 secured together, as by welding or the like, the cutouts 33 will conform to the shape of the segment 20 so that the branch 34 can be secured, as by welding to the segment 20. An opening 29 is formed in the wall of the segment which is aligned with the opening in the port branch.

Figure 4:
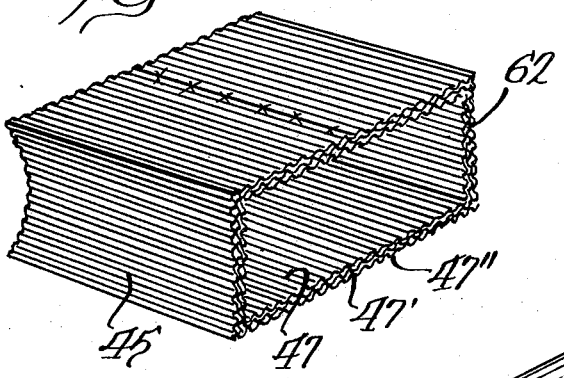
FIG. 4 is a perspective view of a corrugated port element comprised of three layers of corrugated material.

The segments 20,22 and port branches 34,36 are encased in an insulating body 42 which is spaced from the outer surface of the conduit 18 by an air gap 23 and is comprised of two or more concentrically disposed layers of corrugated or crumpled foil material having highly polished surfaces so as to have a high reflectivity factor in use. The insulating body 42 has a conduit portion 43 and two port portions 45. In order to simplify the drawing and the description, the insulating body 42 will be described only with respect to one port portion 45, as shown in FIGS. 3, 5, 8, 10 and 11. It is to be understood, and FIG. 1 illustrates, the insulating body 42 encompasses two segments 20,22 and two port branches 34,36. The port portion 45 encases the port branch 34 and may be made up on the port branch itself or may be made up on a mandrel. Referring to FIGS. 3 and 4, a thin sheet of foil material, such as a stainless steel known as 75–238, Hastelloy X, or the like, is cut into a piece 47 to substantially match in shape but to be bigger in size than the developed sheet 27 of the port branch 34 of FIG. 3. Two or three such pieces 47,47',47", each one slightly larger than the previous one, are cut and are corrugated, crumpled or given a wavy pattern so that portions of each piece 47,47',47" project upwardly and portions project downwardly from the plane of the sheet.

Figure 5:
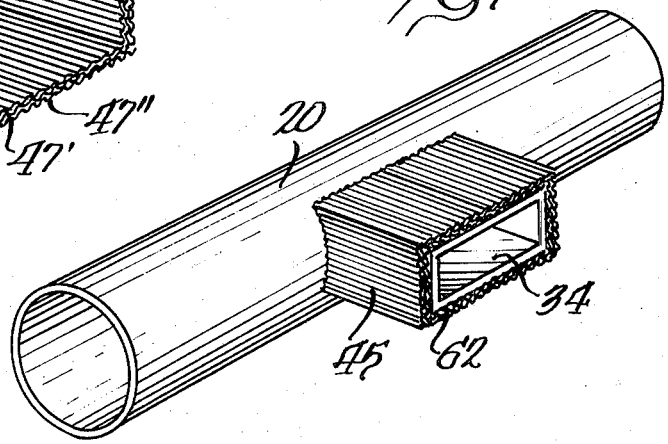
FIG. 5 is a perspective view of the conduit and port branch of FIG. 3 with the port element of FIG. 4 assembled over said port branch.

One piece 47 is shaped on, for instance, a mandrel which mandrel conforms to the shape and size of the outer surface of the port branch 34 with the abutting ends of the piece 47 being secured together as by tack welds or the like. A second piece 47' is then formed concentrically about the first piece 47 preferably with the ends secured together on the diametrically opposite side of the port branch from the first joint. A third piece 47", or more pieces, of corrugated material can be concentrically formed about the previous piece on the mandrel and have the edges of the pieces secured together preferably at staggered locations. Air spaces or air gaps 62 are provided between the corrugations of adjacent pieces of the port portion 45. The resulting port portion 45 of two or more concentric layers of corrugated material is stripped from the mandrel, as shown in FIG. 4, and is slid on the port branch 34, as shown in FIG. 5, with an air gap 21 between the port portion 45 and the port branch 34.

Figure 7:
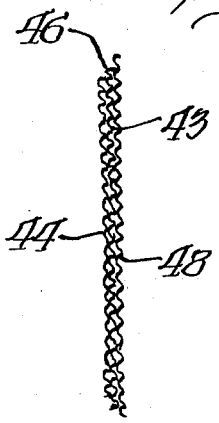
FIG. 7 is an end view of three layers of corrugated material of FIG. 6.
Figure 6:
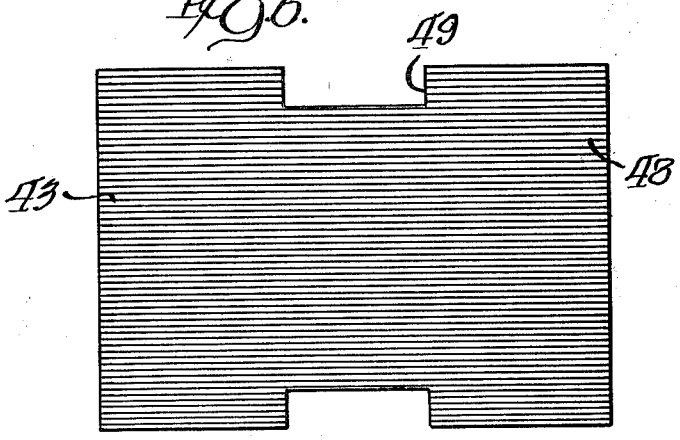
FIG. 6 is a developed view of a layer of corrugated material ready for assembly around the conduit of FIG. 5.
Figure 8:
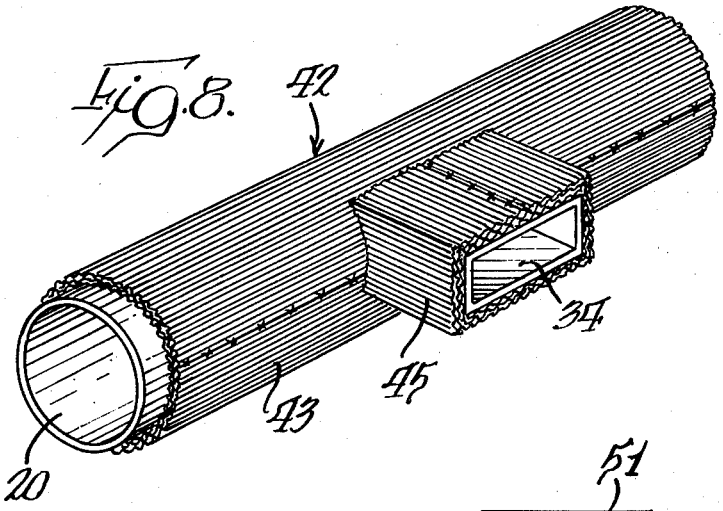
FIG. 8 is a perspective view of the conduit and port branch of FIG. 5 with the layers of corrugated material of FIG. 7 assembled around the conduit.

The conduit portion 43 of the insulating body 42 is made up by cutting two or more pieces of the same thin foil stainless steel material into a developed shape which pieces are then corrugated, crumpled or given a wavy pattern to form members 44,46,48 having a shape of the type shown in FIG. 6 with cutouts 49 in the opposite side edges thereof. Member 44 is slightly larger in width than segments 20,22 but is slightly shorter than combined segments 20,22 so that one end of each segment 20,22 extends beyond the ends of member 44. Members 46,48 are successively larger in width than member 44 but are the same length as member 44. The members 44,46,48 are stacked together face-to-face, as shown in FIG. 7, with the stack then being wrapped around the segments 20,22 in spaced relationship to said segments to provide the air gap 23 therebetween. The abutting edges of the stack are welded, soldered or the like, together to form the conduit portion 43 which conduit portion 43 is welded, soldered or the like, to port portions 45,45 to form the insulating body 42, part of which is shown in FIG. 8. Air spaces or air gaps 69 are provided between adjacent corrugations of the members 44,46,48.

Figure 9:
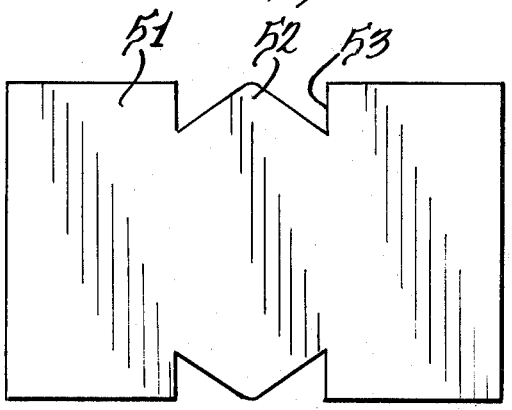
FIG. 9 is a developed view of a wrap for the conduit of FIG. 8.
Figure 10:
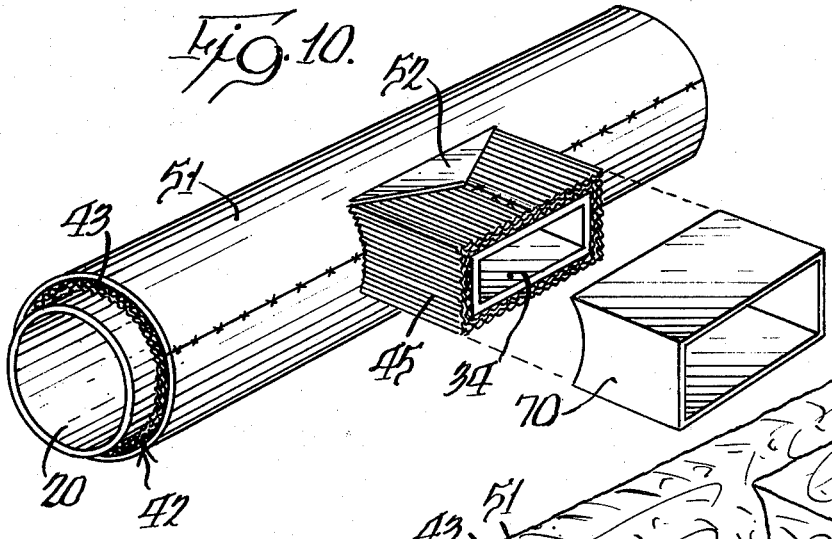
FIG. 10 is a perspective view of the conduit and port branch of FIG. 8 only with the wrap of FIG. 9 assembled therewith.

An intermediate wrap 51 of thin stainless steel is then cut in a developed shape, as shown in FIG. 9, with triangular-shaped tabs 52 being formed in diametrically opposite cutouts 53. The intermediate wrap 51 is formed around the conduit portion 43 with the abutting edges of the wrap 51 being welded, or otherwise secured, together and with the tabs 52 being spot welded, or the like, to the outer surfaces of the port portions 45, part of which is shown in FIG. 10. Optionally, a port sock 70 may be slipped over the port portion 45.

Figure 11:
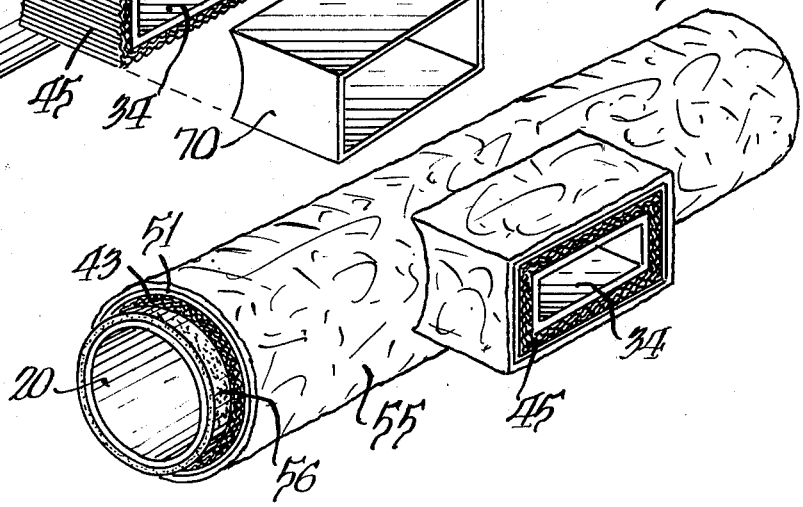
FIG. 11 is a perspective view of the conduit and port branch of FIG. 10 only with an insulating wrap assembled about the conduit and the port branch; and, FIG. 12 is a sectional view of a modified form of the manifold showing the principal elements of the invention in position therein.

A thin wrap 55 of insulating material is then formed around the insulating body 42, as shown in FIG. 11. The thin wrap 55 may be a sheet of Kevlar, Kaowool or Fiber Frax and may be about 0.10" thick. The end openings of the corrugated insulating body 42 are plugged with a core wash of the type which is generally available in most foundries. Thin sleeves 56 of core material are placed over the protruding ends of the segments 20,22.

The wrapped insulating body 42, segments 20,22, core sleeves 56, and branch ports 34,36 are now ready to be placed in a mold and, using well known casting techniques, cast iron is poured into the mold to form the outer casing or section 14 with the flanges 31 on the ends of the conduit section 14 and flanges 37 on the ends of the port branches 39,41. The molten cast iron embeds the ends of the conduit portion 43 of the insulating body 42 and the ends of the port portions 45 of the insulating body 42 therein. The casing or section 14 is removed from the mold and cleaned such that section 14 will have cylindrical openings 57 in the ends between the conduit 18 and the radial inner surface of the flanges 31 where the core sleeves 56 had been during the molding of the section 14. A flanged sleeve 28 can be inserted in said opening 57 on the left end of the section 14 with the flange 30 abutting the end face of the flange 31. An end cap 32 having undercut portion 58 aligned with flange 30 is bolted to the flange 31 of the section 14 with a gasket 59 between said cap and said flange 31. The fit between conduit 18 and flanged sleeve 28 is such as to permit expansion and contraction of said conduit 18.

Figure 2:
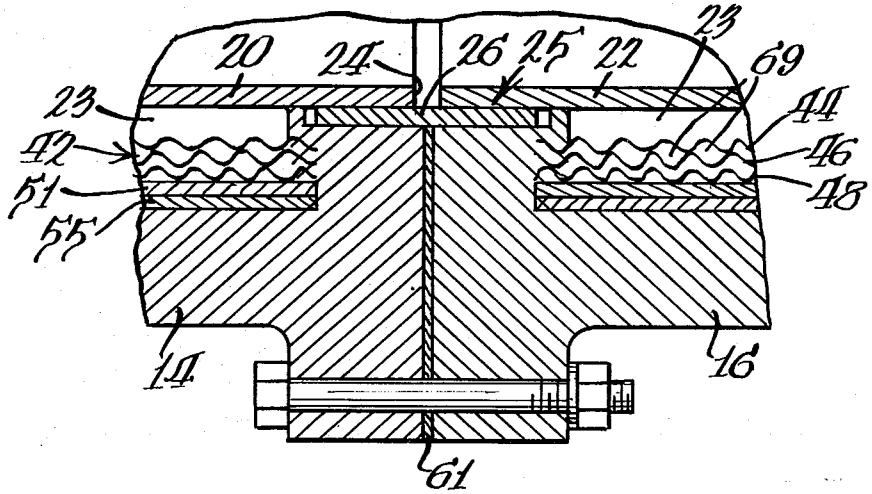
FIG. 2 is an enlarged cross-sectional view of the junction between adjacent sections of the casing of the manifold.

The other end of the section 14 may have the sleeve 26 inserted in said cylindrical opening 57 which sleeve 26 can bridge the spacing 24 between adjacent sections 14,16 when adjacent sections 14,16 are bolted together against a gasket 61 as shown in FIGS. 1 and 2. The fit between the sleeve 28 and segment 20 and between sleeve 26 and segment 22 of the conduit 18 is a slip fit so that only limited exhaust gases are permitted to escape around the end of the exhaust conduit 18 into the open space 23 between the conduit 18 and the insulating body 42.

After the section 14 is removed from the mold, the port branches 34,36 will have outwardly facing ends to which a transversely extending flange 38 will be attached such as by welding or the like. The flanges 38 will nest freely in the undercut portions 35 of the flanges 37 on the port branches 39,41. The manifold is separated from the cylinder head by a gasket 40 and compresses said gasket when bolted to said cylinder head 12. The flanges 38 on the port branches 39,41 will slidably engage with the head 12 around the exhaust opening in the head.

Figure 12:
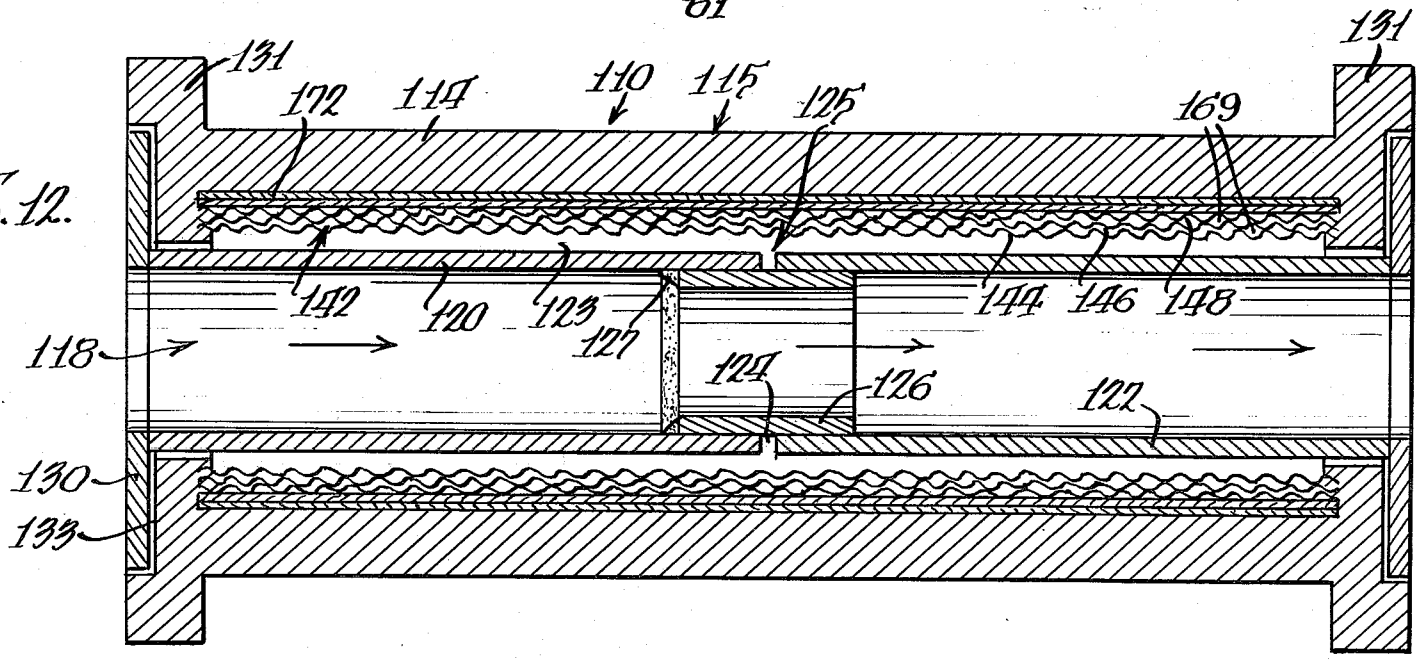

As shown in FIG. 12, a section 114 of the casing 115 of the manifold 110 has end flanges 131 cast on the opposite ends thereof. An exhaust conduit 118 has segments 120,122 which have flanges 130 welded or otherwise secured to the ends of the segments 120,122 and which flanges extend radially outward at one end or the other with the flanges 130 nested in an undercut portion 133 of the flanges 131 of the casing. The adjacent ends of the segments 120,122 of the conduit 118 are spaced apart 124 with the spacing covered by an overlapping sleeve 126 about the inner surface of the conduit. The sleeve 126 is welded or otherwise secured at 127 to the upstream side of the space 124 so as to deflect the exhaust gases through the open center portion of the sleeve. The sleeve 126 is part of a slip joint 125 intended to prevent excessive leakage of the exhaust gases into the space around the exhaust conduit.

An insulating body 142 comprised of three concentric members 144,146,148 or layers of corrugated thin foil material is formed about the exhaust conduit 118 and is spaced 123 from the exhaust conduit 118 and from each other by the amount of spacing 169 created by the engagement of the crests of the corrugations on the respective foil members. The ends of the members of the insulating body 142 are embedded in the casting of the outer casing 115 so that there is no significant flow of air from the space between one member 144 and the next member 146,148. A thin insulation wrap 172 is placed around the outer surface of the insulating body 142 prior to casting the casing thereabout. It is to be understood that an exhaust port could be formed into each segment 120,122 of the exhaust conduit 118 and to do so would necessitate forming a port branch on the exhaust conduit 118 and forming the insulating body 142 with port branches about the outer surface of the port branch. The casing would also include a port branch with flanges for attachment to the engine of the vehicle.

An operative example of the invention includes an outer casing 15 being made of cast iron with the segments 20,22 of the exhaust conduit 18 being made of stainless steel of the 18–8 class. The ends of the exhaust conduits are shielded by the sleeves 28,26, either on the outside or the inside of the joint so as to limit exhaust gases from getting into the air space 23 around the exhaust conduit, thereby keeping the reflective surface of the insulating body clean. The insulating body 42 is comprised of two or more members 44,46,48 of thin stainless steel foil or sheet of the 75-238 class. A commercial example of this type of material would be a Hastelloy X material, although any material that has a high temperature characteristic would be acceptable. The thin foil used to make up the members 44,46,48 of the insulating body 42 has a reflectivity coefficient at 1400° F. of about 30% which means that the material is a fairly good emitter as well as an absorber in that it absorbs about 70% of the radiant energy while radiating about 30%. The surfaces of the foil material should be as shiny as possible so as to give a high reflectivity therefrom. The luster or shine on the thin foil will be lost when the exhaust manifold gets hot, which is the explanation for why the reflectivity coefficient goes down to 30% when the part not only absorbs more heat but also emits more heat to a cooler object which it faces. For stainless steel, a temperature range from 450° F. to 1225° F. in a 301 stainless steel has an emissivity coefficient in the range of 0.54 to 0.63. The joints of the respective layers or members 44,46,48 of the conduit portion 43 and pieces 47,47',47'' of the port portion 45 of the insulating body 42 may be staggered and the port sock 70 may be slipped over the assembled port portions 45 to shape the port branch until it is ready to receive the casing thereabout.

The sectionalized outer casing permits the degree of flexibility desired whereby standard sections can be provided which will be assembled in one, two, or three axially aligned relationships to form manifolds for two-cylinder, four-cylinder, six-cylinder or more cylinder engines. Each section 14 of the manifold has two branch ports 39,41 and includes a conduit 18 with two axially movable segments 20,22. The segments 20,22 are joined by the slip joint 25 to permit expansion of the segments without creating thermal stresses on the casing. The corrugated or crumpled foil of the members makes it possible to have a compact insulating body 42 with air spaces 23,62,69 between the respective members and with the surfaces of the members, both inside and outside, being highly reflective so as to reflect the radiant energy back into the exhaust gases, the result being that relatively little heat is transmitted to the material of the outer casing so that the outer casing remains relatively cool compared to the high temperatures of the exhaust gases.

The embodiment of the invention in which an exclusive property or privilege is claimed is defined as follows:

1. In an exhaust manifold spanning at least two ports of an engine comprising:

(a) an inner conduit of thin steel, (b) at least two concentrically arranged tubular members of highly reflective material encircling said conduit and being spaced from each other and from said conduit, and (c) a casing surrounding the tubular members and conduit and having the ends of said members embedded therein, whereby the reflective surfaces of the members reflect the heat into the conduit so that only limited amounts of heat penetrates to the outer surface of the manifold.

2. In an exhaust manifold as claimed in claim 1 wherein said conduit is comprised of a plurality of axially aligned segments axially spaced from each other, slip joints bridging the space between said segments to reduce the leakage of exhaust gases between said ends.

3. In an exhaust manifold as claimed in claim 1 wherein each said member is a foil having corrugations extending out of the plane of said foil, said corrugations of adjacent members contacting at spots to create the spacing between said foil members from each other.

4. In an exhaust manifold as claimed in claim 3 wherein said foil has a highly reflective surface on each side thereof.

5. In an exhaust manifold as claimed in claim 1 wherein said conduit is divided into at least two axially aligned segments with each segment of the conduit having one branch port radiating therefrom.

6. In an exhaust manifold as claimed in claim 1 wherein the casing is divided into at least two sections, each section having at least two branch ports, flange means on the ends of each section which flange means are bolted together to form the manifold, and a cap bolted to the flange at one end of one section to form the end of the manifold.

7. In an exhaust manifold as claimed in claim 6 wherein each section of said manifold has said tubular members extending from one flange means to the other and wherein each section has said conduit divided into two axially aligned segments with a slip joint bridging the junction between said segments, and wherein each segment has one port branch extending outwardly therefrom.

8. In an exhaust manifold for a multi-cylinder engine having:

(a) an inner conduit of thin steel, said conduit having at least two axially aligned spaced apart segments with a branch port radiating from each segment, (b) an insulating body having at least two concentrically arranged members of highly reflective material encircling said conduit and said branch ports, said members being spaced from each other and from said conduit by air gaps, (c) a wrap of high temperature resistant material encircling the outermost member, and (d) a casing surrounding the wrapped members, the conduit and the branch ports, the ends of said insulating body being embedded in the ends of said casing whereby the reflective surfaces of the members and the air gaps between the members and between the members and the conduit reflects the heat so that only limited amounts of heat penetrates to the outer surface of the manifold.

9. In an exhaust manifold as claimed in claim 8 wherein said conduit is comprised of a plurality of axially aligned segments axially spaced from each other, slip joints are located about the ends of said segments to permit expansion of the segments and to limit leakage of exhaust gases between said segments.

10. In an exhaust manifold as claimed in claim 8 wherein each said member of the insulating body is made of a foil material having corrugations extending out of the plane of said foil, said corrugations of adjacent members contact at contact points to create said space between said foil members.

11. In an exhaust manifold as claimed in claim 10 wherein said foil material has a highly reflective surface on each side.

12. In an exhaust manifold as claimed in claim 8 wherein the casing is divided into at least two sections, each section spans at least two cylinders of the engine, flange means are formed on the ends of each section which flange means are bolted together to form the manifold, a cap is bolted to one end of one section to form the end of the manifold.

13. In a method of manufacturing an exhaust manifold for a multi-cylinder engine comprising the steps of forming an inner conduit of thin steel, forming a member of highly reflective material about the outer periphery of said conduit, said member being spaced from said conduit by an air gap, a wrap of high temperature resistant material is placed about the outer surface of said member, placing said wrapped member and conduit in a mold, pouring a casing of molten metal about said wrapped member and conduit so as to embed the ends of said member in said casing to produce said manifold.

14. In the method of claim 13 wherein said conduit is formed by two axially aligned segments, a slip joint is placed at the junction between said segments, and a plurality of said members are formed one about the other with each member spaced from the adjacent member.

15. In the method of claim 14 wherein said casing is formed in sections with each section having flanges formed on each end for attaching to the flanges on adjacent sections.

16. In the method as claimed in claim 14 wherein each segment of the conduit has a branch port formed thereon, said members have branch ports encircling said branch ports of said segments and said casing has branch ports encircling said branch ports of the conduit and the members.

* * * * *